United States Patent [19]

Erich et al.

[11] 4,389,240

[45] Jun. 21, 1983

[54] ALLOYING METHOD

[75] Inventors: Donald L. Erich, Warwick; Alfred J. Varall, Jr., Middletown; Stephen J. Donachie, New Windsor, all of N.Y.

[73] Assignee: Novamet, Inc., Wyckoff, N.J.

[21] Appl. No.: 396,892

[22] Filed: Jul. 9, 1982

[51] Int. Cl.[3] ..... C22C 1/04; C22C 21/20

[52] U.S. Cl. ..... 75/0.5 B; 420/590

[58] Field of Search ..... 75/0.5 R, 0.5 B; 420/590

[56] References Cited

U.S. PATENT DOCUMENTS

| | | | |
|---|---|---|---|
| 1,922,037 | 8/1933 | Hardy | 75/45 |
| 3,492,114 | 1/1970 | Schneider | 75/53 |
| 3,501,291 | 3/1970 | Schneider | 75/53 |
| 3,563,730 | 2/1971 | Bach et al. | 75/135 |
| 3,957,532 | 5/1976 | Settle et al. | 75/0.5 B |

*Primary Examiner*—W. Stallard

*Attorney, Agent, or Firm*—Francis J. Mulligan, Jr.; Raymond J. Kenny

[57] ABSTRACT

A process for producing an agglomerated metallurgical composition involving contacting a flowable mass of metal powder, e.g. aluminum powder having a melting point above about 500° C. with a lesser mass of alkali metal, e.g. lithium at a temperature between the melting point of the alkai metal and the melting point of the metal of the powder. The contact is made under a protective atmosphere, e.g. argon or helium and is effected by kneading the metal powder and the molten metal for sufficient time to form agglomerates of substantially uniform composition.

4 Claims, No Drawings

ALLOYING METHOD

TECHNICAL FIELD

This invention relates to the formation of powder agglomerated metallic compositions and more specifically to the formation of powder agglomerated metallic compositions containing alkali metals suitable as feedstock for mechanical alloying operations.

BACKGROUND ART

For various purposes, most specifically for metallurgical additive purposes, prior art workers have made combinations of highly reactive metals with less reactive metals. For example, Hardy in U.S. Pat. No. 1,922,037 discloses combining calcium with iron, Schneider in U.S. Pat. Nos. 2,492,114 and 3,501,291 discloses combining nickel and lithium and Bach et al. in U.S. Pat. No. 3,563,730 disclose pre-combining lithium or other alkali metal with various other metals in the presence of an inert liquid.

Lithium-aluminum combinations presumably made by the Bach et al. method are commercially available and have been used as sources of lithium for the manufacture of lithium-containing aluminum alloys having dispersed hardening particulates by the mechanical alloy method. Mechanical alloying which involves the milling of powders until certain criteria of uniformity and saturation hardness are reached, is a technique which can be used to make dispersion hardened alloys. When these very costly, commercially available pre-combined lithium-aluminum compositions are used to make lithium-containing mechanically alloyed aluminum alloys, it is difficult to maintain an alloy carbon content at a low level. Analysis of these commercially available pre-combined lithium-aluminum composition indicates a high carbon content of up to about 1% presumably as a result of paraffinic materials used as the "inert" liquid in manufacture. At present, the cost of these materials is many times the cost of the lithium contained therein. Furthermore, experience with this material indicates that the lithium content varies excessively from batch to batch.

Another source of commercially available relatively expensive lithium-aluminum master alloy is reported to make the master alloy by a complete melting of the ingredients. While this melted material appears to exhibit consistency in composition from batch to batch, its physical form is that resulting from crushing and grinding cast billet. This process is thus effectively limited to the production of relatively brittle master alloy which requires expensive crushing and grinding to obtain powder of a size useable in mechanical alloying equipment.

Since it is desirable to be able to provide mechanically alloyed lithium-containing aluminum alloy powders of low carbon content, and of any selected composition, a different means of making the pre-combination of lithium and aluminum is needed. One might say that the combination could be made simultaneously with mechanical alloying however use of free metallic lithium in a mechanical alloying apparatus (eg. an attritor) is undesirable in that it tends to gum up the attriting elements and other metal powder.

SUMMARY OF THE INVENTION

The present invention comprises a process for producing a readily powderable, agglomerated metallurgical composition wherein a mass of flowable powder of a reactive metal or alloy not readily reduced from oxide state by hydrogen and having a melting point of at least about 500° C. is contacted with a lesser mass of alkali metal at a temperature above the melting point of said alkali metal and below the melting point of said metal or alloy while under a protective gaseous atmosphere and while kneading said contacting metals for a time sufficient to thereby form agglomerates of substantially uniform composition of said contacting metals.

For purposes of this specification and claims "kneading" means the process of mixing into a well-blended whole by repeatedly drawing out and pressing together of materials at a relatively low speed and high torque. This process can be carried out on a large scale in stainless steel double arm mixers or the like such as are described in Encyclopedia of Chemical Process Equipment, Reinhold Publishing Corp. New York(C) 1964 starting on page 641. Metals which can be used as the flowable powder include not only aluminum but also aluminum-rich alloys (i.e. containing greater than about 80% aluminum) such as aluminum-magnesium alloys, aluminum-copper alloys, aluminum-silicon alloys, magnesium, magnesium-rich alloys (i.e. containing greater than about 80% magnesium) and other elements or alloys which are not readily reduced from oxide form by hydrogen. The flowable metal powder can be in any convenient form such as commercially atomized powder, flake or the like. Alkali metals, of course, include sodium, potassium, lithium and cesium mixtures thereof and mixtures of alkali metal or metals with other elements. Protective gaseous atmospheres which can be used in the process of the present invention include argon, helium, krypton, hydrogen, methane and the like either at normal atmospheric pressure or lower or higher pressures.

BEST MODES FOR CARRYING OUT THE INVENTION

For explanatory purposes, the invention is described in terms of the laboratory preparation of an aluminum-lithium master alloy. The preparation which was performed in a dry-He atmosphere glove box, involved spreading a bed of Al powder (80 grams) over the bottom of a shallow, graphite coated stainless steel boat and placing strips of Li metal (20 grams) on top of the Al powder. The Al powder and Li metal in the boat were heated on a hot plate to about 288° C. (Li melts at 191° C., Al melts at 660° C.). Since no obvious wetting of the Al powder occurred, the molten Lithium was mechanically mixed with the Al powder to obtain the desired dispersion. After approximately ½ hour, the mixture was allowed to cool slowly to room temperature. On reheating to 288° C., it was noted that only a few balls of molten metal remained, indicating that most of the Li had combined with the Al. The mixture was then held at 288° C. for an additional ½ hour to promote combinations of the remaining Li metal with the Al powder. After cooling, the partially agglomerated friable mass was readily ground using only a mortar and pestle. The appearance of the resulting powder was very similar to commercially available cast, jaw crushed and rod-milled Al-20Li (weight %) powder. Chemical analysis of the powder prepared by the described process showed:

| | Target(weight %) | Obtained |
|---|---|---|
| Li | 20% | 15.5–18.1 |
| O | — | 0.37 |
| C | — | <.005 |
| N | — | 0.12 |

Repeated preparation of the aluminum-20% lithium master alloy showed that the final composition could be consistently controlled especially as to the lithium and carbon content.

Those skilled in the art will appreciate that the process as specifically described can be varied not only in use of powdered alloys of aluminum but also in that mixtures of powders of aluminum, magnesium, copper, silicon and the like can be employed to tailor-make any desired aluminum-lithium master alloy. Mechanically alloyed materials made with the metallurgical composition prepared in accordance with the present invention have exhibited characteristics which are as good if not better than the characteristics exhibited by alloys made with commercially available lithium-aluminum master alloys.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A process for producing a readily powderable, agglomerated metallurgical composition comprising contacting a mass of flowable powder of a metal or alloy having a melting point of at least about 500° C. with a lesser mass of alkali metal at a temperature above the melting point of said alkali metal and below the melting point of said metal or alloy while under a protective gaseous atmosphere and while kneading said contacting metals for a time sufficient to thereby form agglomerates of substantially uniform composition of said contacting metals.

2. A process as in claim 1 wherein the mass of flowable powder is a mass of powdered metal selected from the group of aluminum, magnesium and alloys rich in aluminum or magnesium.

3. A process as in claim 1 wherein said alkali metal is lithium.

4. A process as in claim 1 wherein the flowable metal powder is aluminum and the alkali metal is lithium.

* * * * *